US005676568A

United States Patent [19]

Weber

[11] Patent Number: 5,676,568

[45] Date of Patent: Oct. 14, 1997

[54] VARIABLE ENTRY CONNECTOR

[75] Inventor: William J. Weber, Eaton, Ohio

[73] Assignee: Belden Wire & Cable Company, Richmond, Ind.

[21] Appl. No.: 623,226

[22] Filed: Mar. 28, 1996

[51] Int. Cl.[6] ..... H01R 13/04

[52] U.S. Cl. ..... 439/694; 439/457

[58] Field of Search ..... 439/449, 456, 439/457, 460, 682, 694

[56] References Cited

U.S. PATENT DOCUMENTS

| | | |
|---|---|---|
| 861,468 | 7/1907 | Kreinsen . |
| 1,520,308 | 12/1924 | Quadri . |
| 2,305,101 | 12/1942 | O'Brien . |
| 2,495,623 | 1/1950 | Benander . |
| 2,511,772 | 6/1950 | Finizie . |
| 2,536,996 | 1/1951 | Holland et al. . |
| 3,032,740 | 5/1962 | Von Hoorn . |
| 3,794,960 | 2/1974 | Sugar . |
| 4,549,780 | 10/1985 | Bertini et al. . |
| 4,575,174 | 3/1986 | Leeds et al. . |
| 5,138,678 | 8/1992 | Briggs et al. . |
| 5,249,970 | 10/1993 | Jennings . |
| 5,416,273 | 5/1995 | Maciejewski . |
| 5,425,645 | 6/1995 | Skovdal et al. . |

*Primary Examiner*—Khiem Nguyen

*Attorney, Agent, or Firm*—Laff, Whitesel, Conte & Saret, Ltd.

[57] ABSTRACT

A variable entry power supply cord-connector. The supply cord-connector has a rounded cord portion coupled to a connector portion. The cord portion is adjustable to a first entry position, a second entry position, and a third entry position. The connector portion has a hollow axial cord channel. The connector portion further defines a hollow transverse cord channel. The connector portion further defines a transverse groove and slot. The axial cord channel intersects the groove and slot. The transverse cord-channel also intersects the slot. A user can pass the cord portion through the groove and slot, thereby changing the entry position of the cord portion. The cord portion, when in its first entry position, extends into the axial cord channel. The cord portion, when in its second entity position, extends into a first exterior opening of the transverse cord channel. The cord portion, when in its third entry position, enters into an opposite second exterior opening of the transverse cord channel.

15 Claims, 3 Drawing Sheets

VARIABLE ENTRY CONNECTOR

FIELD OF THE INVENTION

This invention relates to a variable entry connector and more particularly to a variable entry connector having a connector portion and a cord portion.

BACKGROUND

Many machines are connected to an electric source via a detachable power supply cord-connector. Detachable power supply cord-connectors typically have a female connector portion at one end. The female connector portion couples with a machine such as a computer or monitor.

Detachable power supply cord-connectors offer many benefits over permanently affixed supply cords. For instance, detachable supply cord-connectors offer easy replacement. The machine does not have to be disassembled to replace a worn cord, the cord is simply detached and replaced.

A problem with supply cord-connectors, however, is the manner in which the cord portion of the supply cord is coupled to the connector portion of the supply cord. A power supply cord, for instance, having its cord portion entering the rear of its connector portion, requires the user to position the machine to utilize a rear entry supply cord. The position, however, may not be the optimal location for the machine.

To allow optimal placement of machines, manufacturers provide three types of supply cords: a supply cord with a rear entry cord portion; a supply cord with a left entry cord portion; and a supply cord with a right entry cord portion. It is, however, costly for manufacturers, distributors and users to maintain three types of cords. In addition, the user may have to replace the cord each time it relocates the machine.

My unique and novel invention provides a supply cord-connector that allows a user to vary the position of the cord portion to create a rear entry cord, a right entry cord or a left entry cord. My invention thus allows manufacturers, suppliers and users to stock only a single cord. In addition, users do not need to replace cords every time they relocate the machine.

A previous device connected a plug to a cord portion to allow a user to adjust the cord portion relative to the plug. The cord portion of this plug is rectangular. The rear of the plug has a channel positioned transversely with respect to the plug portion's contacts. The channel has lips. A user can by twisting the cord, manipulate the cord portion into the channel. The cord thus enters the plug from the side.

This type of plug design focuses on allowing a user to manipulate the position of the cord at the point of connection to a power outlet. The intent being to hide unsightly cords. The design is not directed towards allowing a user to vary the cord portion relative to a connector portion at the point of coupling to a machine. Thus, this type of plug does not provide a means which allows for optimal placement of the machine and would not be relied on by one skilled in the art of applicant's invention. In addition, the mechanics of how a user adjusts this plug has drawbacks.

One problem with the plug is that the gap between the plug's lips must be kept relatively wide, otherwise, the cord cannot be manipulated into the channel. Maintaining wide gaps, however, cuts down on the ability of the plug portion to sufficiently retain the cord portion. The mechanisms of my variable entry connector are superior.

My connector portion, at its rear surface, has a slot located at the base of a groove. The groove has a depth which decreases and outer edges which narrow as the groove extends towards the sides of the connector portion. In addition, parts of the rear surface of my connector portion are slanted towards the face of the connector. The user passes the cord portion through the uniquely contoured groove and slot and into a transverse channel causing the cord to extend from the side.

Having the slot at the base of a groove, and having the uniquely contoured groove, facilitate the positioning of the cord in the transverse channel. My unique connector portion allows for a very narrow slot and enhanced retention of the cord portion in the transverse channel.

The shape of my cord portion further facilitates the positioning of the cord in the transverse cord channel. My cord portion has a circumferential cross section. The circular cord portion moves through the slot easier than a rectangular cord.

Another known device discloses an electrical connector that employs a pair of identical body portions which are mated together to grasp an electrical conductor and to provide strain relief to the exiting electrical conductor. Each body portion contains an integrally molded axial half channel and an integrally molded transverse half channel. The body portions when mated form generally cylindrical channels for the passage of a cable sheath. Redirecting the cable requires disassembly and reassembly of the body parts. The device does not encompass a power supply cord but rather is narrowly directed towards a cord which transmits electrical signals. My invention is superior.

It allows the user to vary the position of the cord portion without disassembly and reassembly. My invention allows for the use of a connector portion comprising a single molded piece rather than cumbersome multiple parts.

Another known device is directed towards a fiber optic connector comprising a housing and an optical fiber cable. The optical fiber cable is connected to the housing via a fixture. The fixture interlocking with the housing angularly points the cable relative to the housing. The fixture may be attached to the housing in any of four positions. Each position points the cable relative to the housing in a different angular direction. Again, my invention is superior to this connector.

My invention does not require connection and reconnection of the cable portion to the connector portion to cause a redirection. My supply cord connector does not require the numerous subparts, i.e., a fixture and a housing. My invention does not require disassembly and reassembly to change direction.

SUMMARY

In one embodiment of the invention, applicant provides a variable entry power supply cord-connector which has a rounded cord portion. The cord portion being adjustable to a first entry position, a second entry position, and a third entry position. The supply cord-connector further has a connector portion coupled to the cord portion. The connector portion has a first and a second side.

The connector portion defines a hollow axial cord channel. The axial cord channel is sized to fit around the cord portion. The cord portion, when in its first entry position, extends into the axial cord channel through an exterior opening of said axial cord channel.

The connector portion further defines a hollow transverse cord channel. The transverse cord channel is sized to fit around the cord portion when the cord portion is in its second and third entry position. The transverse cord channel has a first exterior opening and an opposite second exterior opening. The transverse cord channel intersects the axial cord channel.

The connector portion further defines a transverse groove. The transverse groove extends in a direction along a transverse length of the transverse cord channel. The axial cord channel intersects the groove.

The connector portion further defines a slot. The slot opens through an exterior surface of the groove and into the transverse cord channel. The slot also opens into the axial cord channel from both the first and the second sides of the connector portion. The slot extends in a direction along the transverse length of the transverse cord channel. The slot opens into the first exterior opening and the opposite second exterior opening.

My invention can alternatively be described as a detachable power supply cord-connector that has a substantially circumferential cord portion. The cord portion being adjustable to a first entry position, a second entry position, and a third entry position. The supply cord further has a connector portion coupled to the cord portion.

The connector portion defines a hollow axial cord channel. The axial cord channel is sized to snugly fit around the cord portion when in its first entry position. The cord portion, when in its first entry position, extends into the axial cord channel through an exterior opening of said axial cord channel.

The connector portion further defines a hollow transverse cord channel. The transverse cord channel is sized to snugly fit around the cord portion when the cord portion is in its second entry and third entry position. The transverse cord channel has a first exterior opening and an opposite second exterior opening. The transverse cord channel intersects the axial cord channel.

The connector portion further defines a slot. The slot opens through an exterior surface of the connector portion. The slot opens into the transverse cord channel. The slot opens into the axial cord channel from both the first and the second sides of the connector portion. The slot extends in a direction along a transverse length of the transverse cord channel. The slot opens into the first exterior opening and the opposite second exterior opening.

Accordingly, the present invention desires to provide a supply cord-connector which improves upon the prior art.

It is still another desire of the invention to provide a supply cord-connector that allows for optimal placement of machines.

It is still a further desire of the invention to provide a supply cord-connector wherein the user can vary the position of the cord portion to provide a cord having a first entry position, a second entry position and a third entry position.

It is still a further desire of the invention to provide a supply cord-connector with a groove defined by the exterior surface of the supply cord's connector portion. The groove contoured to allow the cord portion of the supply cord to be easily adjusted.

It is still another object of the invention to provide a supply cord-connector with a cord portion contoured to allow the cord portion to be easily adjusted.

Other desires, results, and novel features of the present invention will become more apparent from the following drawings, detailed description and the accompanying claims.

DETAILED DESCRIPTION

Figure 1:
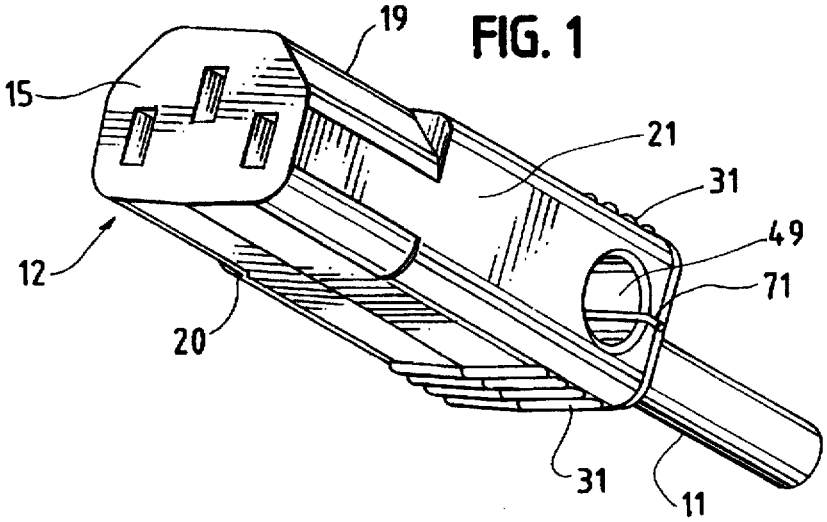
FIG. 1 is a perspective view of one embodiment of my invention, looking into its bottom, side, face and top.
Figure 1A:
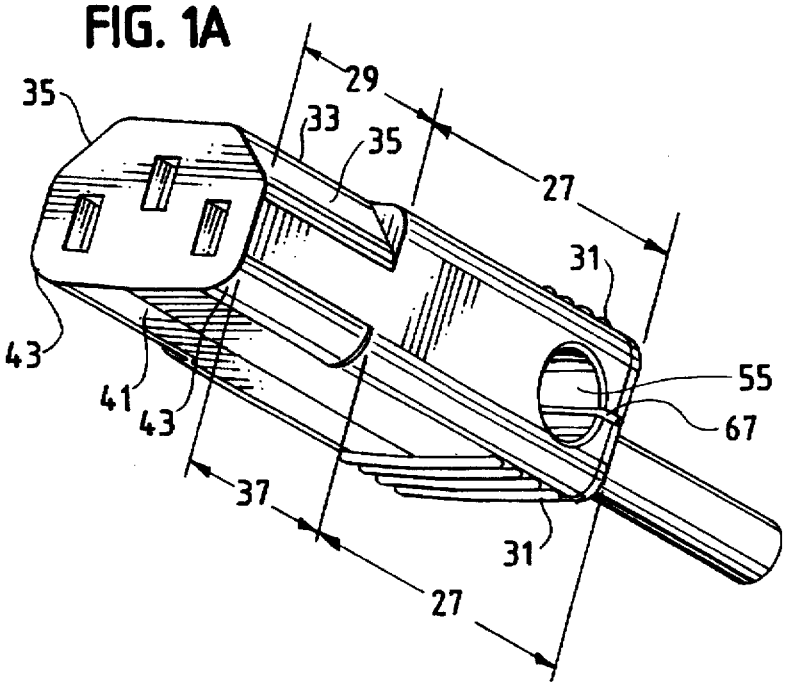
FIG. 1A is the same perspective view as FIG. 1.
Figure 2:
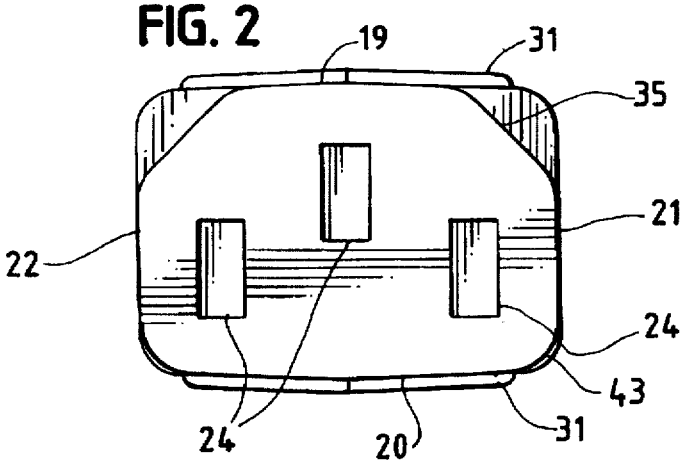
FIG. 2 is a view looking into the face of the shown embodiment of my invention.

Referring to FIGS. 1–8, which shows one embodiment of my invention. A cord portion (11) is coupled to a connector portion (12). The detachable supply cord-connector shown is a detachable power supply cord. The cord portion has a rounded shape. The rounded shape shown is substantially circumferential.

The cord portion is a 3-conductor cord having a rubber or plastic jacket.

The connector portion (12) is a female connector. The shown connector portion (12) comprises a single molded piece of rubber or plastic. The connector portion, in part, defines a front comprising a face surface (15), a rear comprising a rear surface (17), a top comprising a top surface (19), a bottom comprising a bottom surface (20), a first side comprising a first side surface (21) and a second side comprising a second side surface (22).

The connector portion allows the detachable supply cord-connector to be electronically coupled to a desired machine. The shown connector portion includes three channels (24). The connector portion also includes contacts (25). The channels (24) open through the exterior of the face surface and extend substantially parallel with the first and second sides. Each of the three channels has at least one of the contacts located within each channel. The contacts and channels are sized to allow connection of the supply cord connector with the machine.

The top surface of the connector housing comprises a grip surface (27) and a top electronic coupling surface (29). The grip surface is substantially perpendicular to the first and second side surfaces. The rear portion of the grip surface has grip ridges (31).

The top electronic coupling surface has a central region (33) which is perpendicular to the first and second sides. The electronic coupling surface also has two angled flat portions (35). The two angled flat portions are each sloped. One flat portion extends from the first side surface of the connector portion and the other flat portion from the second side surface of the connector portion. Each flat portion extends towards the central region.

The bottom surface of the connector portion also comprises grip surface (27) and a bottom electronic coupling surface (37). The grip surface is substantially perpendicular to the first and second side surfaces. The rear portion of the grip surface has grip ridges (31).

The bottom electronic coupling surface has a central region (41) which is perpendicular to the first and second side surfaces. The bottom electronic coupling surface has two rounded portions (43). One of the two rounded portions is integral with the first side surface and the other of the two with the second side surface. Both are integral with the bottom central region.

Figure 3:
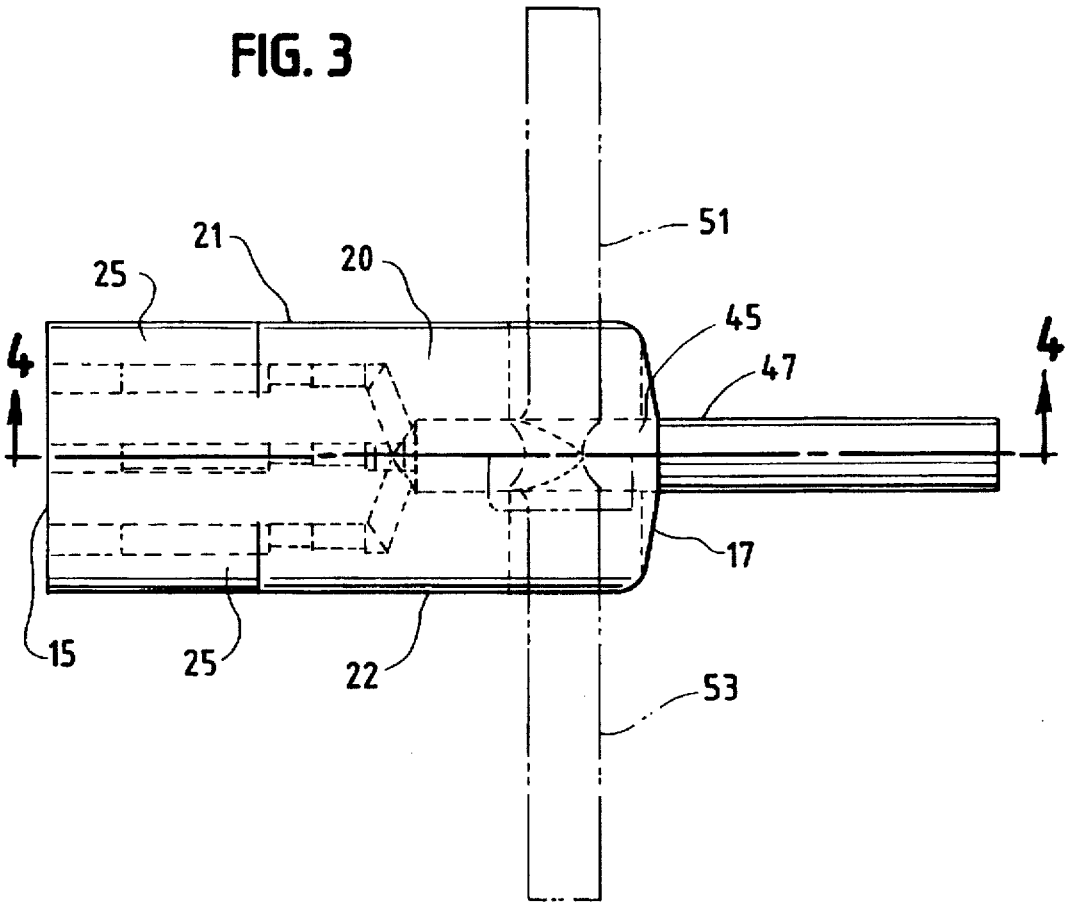
FIG. 3 is a bottom view of the shown embodiment of my invention showing the cord portion terminating into the contacts; the view further shows the adjustable positions of the cord portion: first entry portion (60), second entry portion (61) and third entry portion (62).
Figure 4:
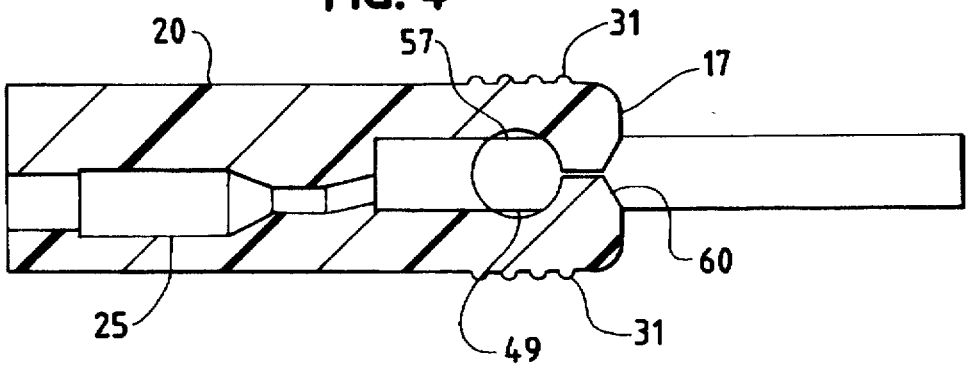
FIG. 4 is a side cross-sectional view of the shown embodiment of my invention taken along view lines A—A.
Figure 5:
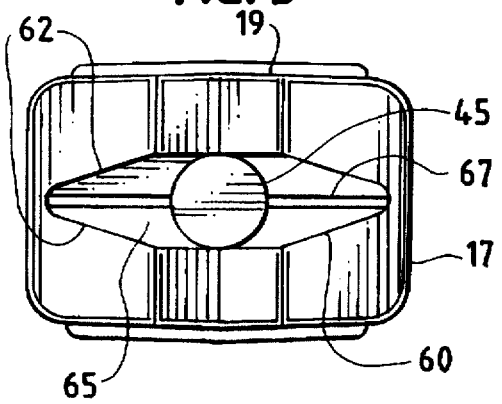
FIG. 5 is a rear view of the shown embodiment of my invention.
Figure 5A:
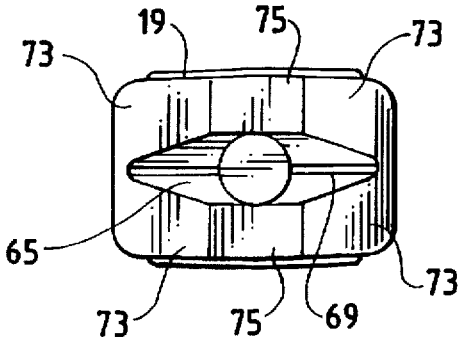
FIG. 5A is the same perspective view as FIG. 5.

The connector portion in part defines a hollow axial cord channel (45) which has an exterior opening. The exterior opening opens through the central area of the rear surface of the connector portion. The axial cord channel extends axially in a direction towards the face surface and is substantially parallel to the top and bottom surface and the first and second side surfaces. The axial cord channel is sized to snugly fit the cord portion. The cord portion, when in its first entry position (47), extends into the axial cord channel through the exterior opening and terminates into the contacts as seen in FIG. 3.

The connector portion also defines a hollow transverse cord channel (49). The transverse cord channel is sized to snugly fit around the cord portion when the cord portion is in its second entry position (51) and third entry position (53). The transverse channel includes a first exterior opening (55) and an opposite second exterior opening; the first and second openings being opposite each other. The first exterior opening (55) opens through the rear portion of the first side surface and the opposite second exterior opening (56) opens through the rear portion of the second side surface. The cord, when in its second entry position, extends into the transverse cord channel via the first exterior opening on the first side. The cord, when in its third entry position extends into the transverse cord channel via the opposite second exterior opening on the second side.

The transverse cord channel is substantially perpendicular to the axial cord channel and intersects the axial cord channel. The transverse channel is parallel to the face and has a transverse length which extends across the width of the connector portion.

A segment of the cord portion (57) passes through the intersection of the axial and transverse cord channels. The segment of the cord portion passing through this intersection is fully jacketed. The individual conductors not being visible and not having begun their termination into the contacts.

The exterior surface of the connector portion also defines a transverse groove (60). The groove extends in a direction along the rear surface and the width of the connector portion. The groove extends in a direction along the transverse length of the transverse cord channel. The exterior opening of the axial cord channel intersects the groove. The groove extends from the intersection towards both the first and second sides and the first and second exterior openings opposite each other.

The groove comprises a plurality of pairs of outer edges (62). Each pair of outer edges converge towards each other. Each pair of edges converge towards the first and second exterior openings opposite each other and the first and second sides. Each pair of outer edges diverge away from each other towards the area of the intersection of the groove with the axial chord channel.

The depth of the groove decreases towards the first and second exterior openings opposite each other and the first and second sides. The depth of the groove increases towards the area of intersection with the axial cord channel.

The groove comprises flat groove surfaces (65). The flat groove surfaces extend from each pair of the groove's outer edges towards the face surface and the grooves depth.

A slot (67) is defined by the connector portion. A first portion of the slot (69) has an exterior slot opening which opens through the exterior of the rear surface and opens into the transverse cord channel. The axial cord channel intersects the first slot portion. This first slot portion extends from its intersection with the axial cord channel towards the first and second exterior openings opposite each other and the first and second sides.

The first slot portion opens into the axial cord channel from the first and second sides. The first slot portion extends in a direction along the rear surface and the width of the connector. This first slot portion extends in a direction along the transverse length of the transverse cord channel. In the shown embodiment the exterior opening of the first slot portion opens through the exterior surface of the base portion of the groove.

A second portion of the slot comprises a first and second exterior slot side opening (71). The first side slot opening opens through the rear portion of the first side surface. The second side slot opening opens through the rear portion of the second side surface. The first side slot opening opens into the first exterior opening. The second side slot opens into the opposite second exterior opening. The first portion of the slot is integral with the first and second exterior side slot openings.

Portions of the rear surface of the connector housing are angled and define a plurality of slanted surfaces (73). The slanted surfaces slope towards the face. The slanted surfaces extending from near where the exterior opening of said axial cord channel intersects said groove. In the shown embodiment, the slanted surfaces (73) extend from a flat mid section (75) of the rear surface. The slanted surfaces extend transversely towards the first and second exterior openings opposite each other and the first and second sides. The portions of the rear surface defining the slanted surfaces are outside of the portions of the rear surface defining the flat groove surfaces.

The increasing depth of the groove and the diverging pairs of outer groove edges help facilitate the initial positioning of the cord portion through the slot. The narrowing of the pairs of outer groove edges and the lessening of the depth of the groove helps to ensure a satisfactory retention of the cord portion when the cord is in its second or third entry position.

Figure 6:
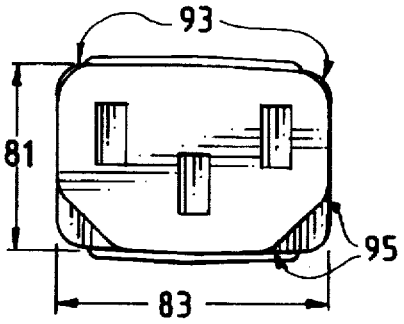
FIG. 6 is a face view of the shown embodiment of my invention indicating various dimensions of the connector portion.
Figure 7:
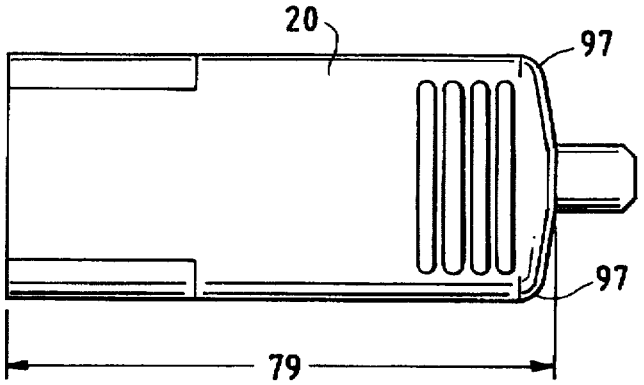
FIG. 7 is a bottom view of the shown embodiment of my invention indicating various dimensions of the connector portion.
Figure 8:
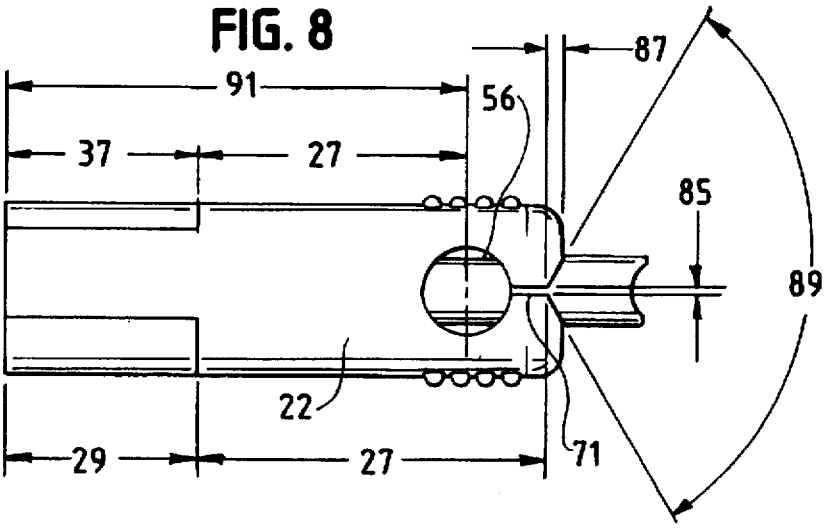
FIG. 8 is a side view of the shown embodiment indicating various dimensions of the connector portion.

Referring to FIGS. 6–8, we illustrate one example of a standard size variable entry connector. The dimensions hereinafter set forth are preferred dimensions that will permit our variable entry connector to be used for most computer applications. The connector portion has a length from the face surface to the rear surface of 2.146 inches (79). The connector portion has a height from its bottom surface to its top surface of 0.622 inches (81). The width of the connector portion from the first side to the second side is 0.905 inches (83). The height of the slot is 0.020 inches (85). The depth of the groove measured from the portion of the slant closest to the face surface is 0.066 inches (87). The angle formed by the flat groove surfaces is 120° (89). The length measured from the face surface to the center of the transverse cord channel is 1.793 inches (91). The center of the transverse cord channel being the center of the circle formed by a cross-section of the transverse cord channel. The cross section being taken along a plane parallel to the first and second sides. The rounded portions of the bottom electronic coupling surface have a radius of 0.156 (93).

The angled flat portions of the top electronic coupling surface are integral with the central region of the top electronic coupling surface and the side surfaces of the connector housing via rounded surfaces. The rounded surfaces having a radius of 0.122 (95). The axial and transverse cord channels having a diameter of 0.312. The rear surface is integral with the side surfaces via rounded portions (97). The rounded portions have a radius of 0.093 inches.

It will, of course, be appreciated that the embodiment which has just been described has been given purely by way of illustration and the invention is not limited to the precise embodiments described herein; various changes and modifications may be effected by one skilled in the art without departing from the scope or spirit of the invention as defined in the appended claims.

What is claimed is:

1. A variable entry supply cord-connector comprising:

a cord portion having a rounded shape, said cord portion being adjustable to a first entry position, a second entry position and a third entry position;

a connector portion coupled to said cord portion, said connector portion having a first and a second side;

a hollow axial cord channel defined by said connector portion, said axial cord channel being sized to fit around said cord portion; said cord portion, when in said first entry position, extends into said axial cord channel through an exterior opening of said axial cord channel;

a hollow transverse cord channel defined by said connector portion, said transverse cord channel sized to fit around said cord portion when said cord portion is in the second entry position and in the third entry position, said transverse cord channel having a first exterior opening and an opposite second exterior opening, said transverse cord channel intersecting said axial cord channel;

a transverse groove defined by the connector portion, said groove extending in a direction along a transverse length of said transverse cord channel, said groove intersecting said axial cord channel;

a slot defined by said connector portion; said slot opening through an exterior surface of the groove and into the transverse cord channel, said slot opening into said axial cord channel from both the first and the second sides of said connector portion, said slot extending in a direction along the transverse length of the transverse cord channel, said slot opening into said first exterior opening and said slot opening into said opposite second exterior opening.

2. The variable entry supply cord as claimed in claim 1 wherein said groove has a plurality of pairs of outer edges, each pair of outer edges converging towards each other as the groove extends towards said first and second exterior openings opposite each other.

3. The variable entry supply cord as claimed in claim 1 wherein said groove has a depth which decreases as the groove extends towards said first and second exterior openings opposite each other.

4. The variable entry supply cord as claimed in claim 1 further comprising a plurality of slanted surfaces, said slanted surfaces extending transversely towards said first and second exterior openings opposite each other.

5. The variable entry supply cord as claimed in claim 1 wherein said rounded cord portion is substantially circumferential.

6. The variable entry supply cord as claimed in claim 1 wherein said connector portion is a female connector.

7. The variable entry supply cord as claimed in claim 1 wherein said connector portion includes a top surface comprised of a grip surface and an electronic coupling surface.

8. A variable entry supply cord as claimed in claim 7 wherein said electronic coupling surface includes a central region and a plurality of angled flat portions.

9. A variable entry supply cord-connector comprising:

a cord portion, said cord portion being adjustable to a first entry position, a second entry position and a third entry position;

a connector portion coupled to said cord portion, said connector portion having a first and a second side;

a hollow axial cord channel defined by said connector portion, said axial cord channel being sized to fit around said cord portion; said cord portion, when in said first entry position, extends into said axial cord channel through an exterior opening of said axial cord channel;

a hollow transverse cord channel defined by said connector portion, said transverse cord channel sized to fit around said cord portion when said cord portion is in the second entry position and in the third entry position, said transverse cord channel having a first exterior opening and an opposite second exterior opening, said transverse cord channel intersecting said axial cord channel;

a transverse groove defined by the connector portion, said groove extending in a direction along a transverse length of said transverse cord channel, said groove intersecting said axial cord channel;

a slot defined by said connector portion; said slot opening through an exterior surface of the groove and into the transverse cord channel, said slot opening into said axial cord channel from both the first and the second sides of said connector portion, said slot extending in a direction along the transverse length of the transverse cord channel, said slot opening into said first exterior opening and said slot opening into said opposite second exterior opening.

10. The variable entry supply cord as claimed in claim 9 wherein said groove has a plurality of pairs of outer edges, each pair of outer edges converging towards each other as the groove extends towards said first and second exterior openings opposite each other.

11. The variable entry supply cord as claimed in claim 9 wherein said groove has a depth which decreases as the groove extends towards said first and second exterior openings opposite each other.

12. The variable entry supply cord as claimed in claim 9 further comprising a plurality of slanted surfaces, said slanted surfaces extending transversely towards said first and second exterior openings opposite each other.

13. The variable entry supply cord as claimed in claim 9 wherein said connector portion is a female connector.

14. The variable entry supply cord as claimed in claim 9 wherein said connector portion includes a top surface comprised of a grip surface and an electronic coupling surface.

15. A variable entry supply cord as claimed in claim 14 wherein said electronic coupling surface includes a central region and a plurality of angled flat portions.

* * * * *